US005445314A

United States Patent [19]

Newsome

[11] Patent Number: 5,445,314

[45] Date of Patent: Aug. 29, 1995

[54] SPACE SAVER PIZZA BOX AND METHOD OF USE

[76] Inventor: Reginald W. Newsome, 216 Philray Rd., Richmond, Va. 23236

[21] Appl. No.: 103,295

[22] Filed: Aug. 6, 1993

[51] Int. Cl.[6] ..... B65D 25/04

[52] U.S. Cl. ..... 229/120.21; 229/147; 229/165

[58] Field of Search ..... 229/120.011, 120.21, 229/147, 151, 169, 177, 178, 165

[56] References Cited

U.S. PATENT DOCUMENTS 1,363,436 12/1920 Richardson ..... 229/177 X
2,850,224 9/1958 Meinhardt et al. ..... 229/120.21
3,677,458 7/1972 Gosling ..... 229/120.011
4,836,383 6/1989 Gordon et al. ..... 229/120.21 X
4,913,291 4/1990 Schuster ..... 229/120.011
4,913,340 4/1990 Ilitch ..... 229/906 X
4,944,452 7/1990 Kent et al. ..... 229/120.21
4,957,237 9/1990 Madonna et al. ..... 229/120.21 X
5,002,188 3/1991 Dickie ..... 229/120.21 X
5,049,710 9/1991 Prosise et al. ..... 229/120.21 X

*Primary Examiner*—Allan N. Shoap
*Assistant Examiner*—Christopher McDonald

[57] ABSTRACT

A space saving pizza box and method of use with the box being half as wide as it is long containing upper and lower stacked compartments with one-half of a circular pizza in each compartment and a panel separating the two compartments that is a cover for the lower compartment and a floor for the upper compartment.

5 Claims, 7 Drawing Sheets

SPACE SAVER PIZZA BOX AND METHOD OF USE

THE FIELD OF THE INVENTION

The present invention relates to a box for pizzas and similar food products.

BACKGROUND OF THE INVENTION

There are basically two ways of packaging large size pizzas. One is a square box, usually about 15" square and 1¾" deep. The other way is cardboard tray with two large pizzas carried side by side thereon which are slid into a paper bag. Both of these packages are difficult and awkward to handle, and hard to negotiate through doorways. Also, the large pizza box is so large it is difficult to fold and discard into a conventional size trash can, difficult to put in a refrigerator, and difficult to fit into a standard size microwave oven.

SUMMARY OF THE PRESENT INVENTION

The present invention is a box and method for large pizzas where the pizza is divided in half and the two halves are placed one over the other in a spaced apart manner in a special box. The box is approximately ½ the width of a standard pizza box, and approximately twice as high as a standard pizza box. It has an interior divider panel which serves as floor for the top half of the pizza and as a Cover for the lower half of the pizza. A preferred size is a two compartment box that is approximately 7½ inches wide, and about 15½ inches long, and approximately 3½ inches thick as a replacement for a 15 inch square and 1¾ inch thick box. Such a space saver box is easy to handle and tuck under the arm, and when carried, permits easy passages through doors and in and out of cars. It is easy to store in a refrigerator, discard in a trash can or placed in a microwave oven. If the entire pizza is not eaten at one time the preferred design permits the top to be torn off, and the remaining half of the pizza stored in its own box, in a refrigerator for later consumption. The box has a reduced total exterior surface area for better heat retention. It also uses substantially less materials than the square box which it replaces.

BRIEF DESCRIPTION OF THE DRAWINGS

The above as well as other advantages and features of the present invention will be described in greater detail according to the preferred embodiments of the present invention in which.

DETAILED DESCRIPTION OF THE PREFERRED EMBODIMENTS

Figure 1:
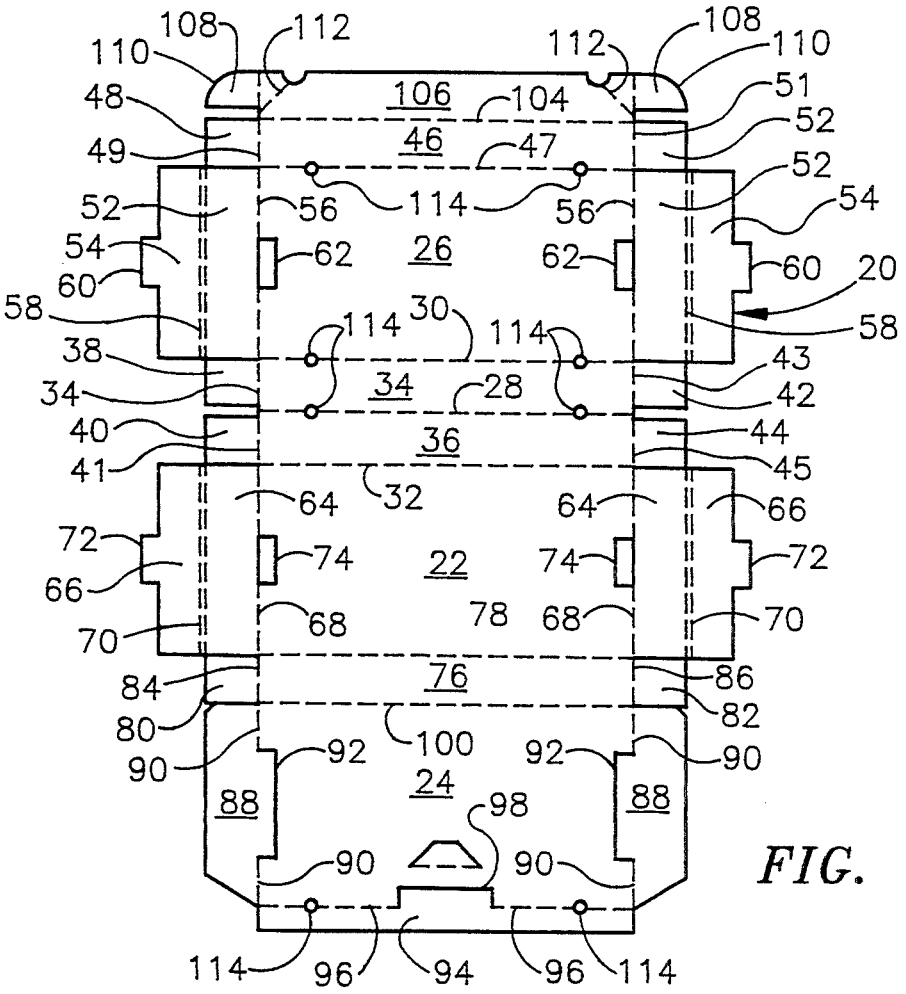
FIG. 1 shows a plan view of the preferred embodiment of the pizza box before folding.

With reference to FIG. 1, the box blank 20 has three major panels: the bottom floor panel 22, top floor panel 24 and top cover panel 26. In assembling the box, it is folded 180 degrees on single score line 28. Bottom floor panel 22 and top cover panel 26 are then folded 90 degrees about single score lines 32 and 30, respectively, so that subpanel 34 and 36 are folded next to one another. Subpanel 36 forms the back wall of the bottom floor panel 22 and subpanel 34 forms the back wall of the top cover panel 26 which hinges about score line 28. Next, tabs 38, 40, 42, and 44 are folded inward 90 degrees along score line 39, 41, 43 and 45, respectively. Subpanel 46 is folded upward 90 degrees about single score line 47 and tabs 48 and 50 are folded inward 90 degrees about score lines 49 and 51, respectively. Then the end panels at each end of top cover panels 26 are folded. The outside end panel 52 is folded 90 degrees inward along single perforated fold line 56 to a vertical position followed by the inside end panel 54 being folded along fold line 58 which is formed of a double row of spaced perforations which are parallel to each other with a spacing between the perforations approximately 3 times the thickness of the corrugated kraft E flute board from which the entire box is made. The inside end panel 54 is folded over the folded end tabs 38, 42, 48 and 50 and the locking tab 60 is locked into the locking slot 62.

Subpanel 76 is then raised to a vertical position by bending about score line 78 and tabs 40, 44, 80, and 82 are bent inwardly 90 degrees about score lines 41, 45, 84, and 86, respectively. This is followed by bending outside end panels 64 to a vertical position about score line 68. Then inside end panels 66 are folded 180 degrees about double perforated fold lines 70, to the inside where locking tabs 72 are locked in there respective locking spots 74.

The assembled box is now ready to receive pizza or similar food products. For example a large piece of pizza on the order of 15 inches in diameter, is cut in half. The first half is placed on bottom floor panel 22 which is surrounded by vertical walls to form a shallow tray. Support panels 88 are attached at each end of top floor panel 24 by a discontinued score lines 90. The discontinuous score lines 90 are interrupted with no score line by stop or guide 92 which extends partially into the top floor panel 24 and whose purposes are explained infra.

At the lengthwise end of top floor panel 24 is a tuck tab 94, connected by a discontinuous score line 96 to top floor panel 24. Score line 96 is interrupted by a stop or guide 98 which does not have a score line and which extends partially into the top floor panel 24. Support panels 88 and tuck tab 94 are folded 90 degrees in a vertical direction about score lines 90 and 96, respectively, and top floor panel 24 is folded about perforated score line 100 so as to cover the first half of the pizza present in the shallow tray having the bottom floor panel 22. In this position the edge of the two support panels 88 rest on the bottom floor panel 22 and served to support the ends of the top floor panel 24 and the tuck tab 94 stiffens the long edge of the top floor panel 24. The box is now a shown in FIG. 2 where it can be seen that the stop or guides 92 and 98 are in a short vertical position. Since they were connected to top floor panel 24 with no score line, they did not bend but formed short upstanding walls that permit the second half of the pizza to be guided onto a top floor panel 24 and prevented from sliding off.

Rectangular opening 102 are in the top floor panel 24 along the base of the stop or guides 92 and 98 to provide additional vent holes and are created automatically by the stop or guides 92 and 98 since they were cut from those openings.

Running along side subpanel 46 and held there too by a perforated score line 104 is locking panel 106. At each end of locking panel 106 are locking tabs 108 separated by a hinged score line 110. It is to be noted that the locking tabs 108 have a quarter circle outer shape and are scored with diagonal bend lines 112 which run from the vicinity of the inside end of score line hinges 110 at approximately 45 degrees to the edge of locking panel 106. This is to facilitate limited hinging about the line when the locking tabs are placed into position.

After the second half of the pizza is placed on the top floor panel 24, the top cover panel 26 is pivoted about score line 28 so as to cover the pizza. The cover is held in place by the locking tabs 108 being folded 90 degrees inward and inserted in the space between the outer surface of tabs 80 and 82 and the inner surface of outside and panel 64. To accommodate the locking tabs 108 being inserted, the locking panel 106 can hinge about perforated score line 104 and the tabs can hinge about score bend line 112. As locking tabs 108 are rotated into position, the quarter circled edge permits easy insertion and later withdrawal when the box is open.

Figure 2:
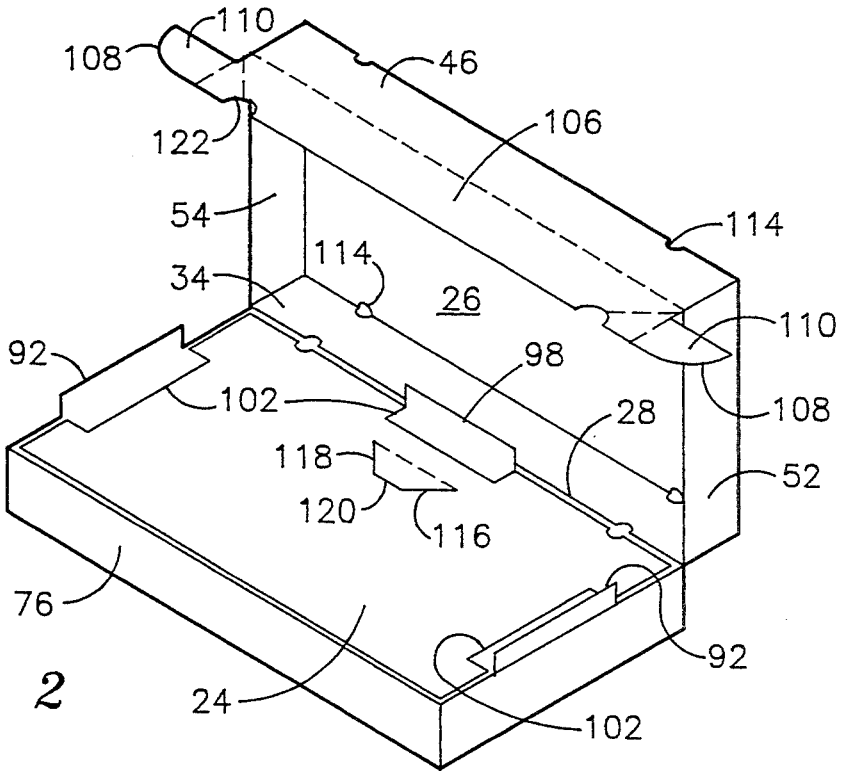
FIG. 2 is a perspective view of the preferred embodiment after the box had been assembled with the top compartment shown in the open position.
Figure 3:
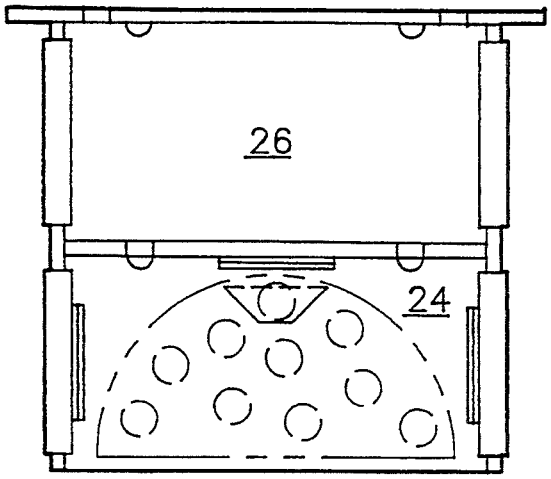
FIG. 3 is a plan view of the assembled box with the top opened showing the position of the top half pizza in the top compartment.
Figure 4:
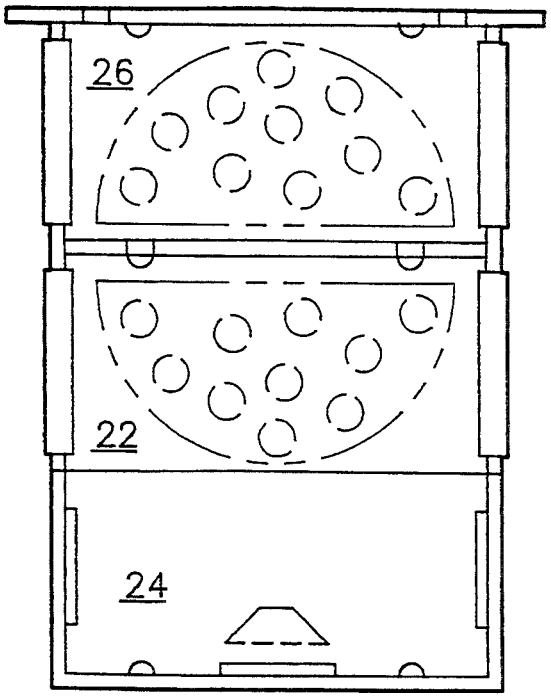
FIG. 4 is a plan view of the box completely open showing the bottom half pizza in the bottom compartment.
Figure 5:
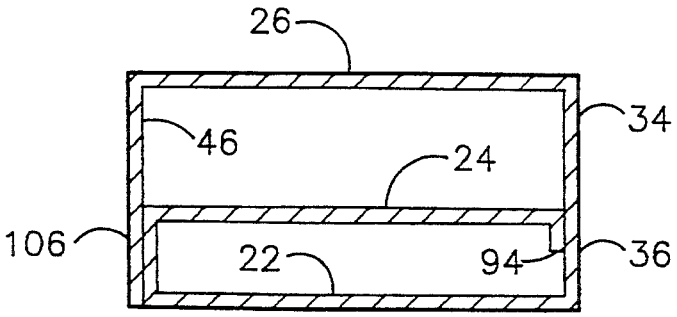
FIG. 5 is a transverse cross section of the box of FIGS. 1 to 4.

Also, provided on the box of FIGS. 1 and 2 are vent holes 114 which permit venting of moisture from the pizza. Lifting tab 116 is held to top floor panel 24, by a perforated hinge line 118. The remaining edges of the lifting tabs are cut lines 120. This tab can be pushed down from the cut lines about hinge line 118 to give a finger grip so that the top floor panel can be hinged open to expose the first or bottom half of the pizza. Also, finger cut outs 122 are provided at the outer edge of locking panel 106 to facilitate the insertion of fingers to unlock the panel when the box is opened. With reference to FIG. 3, there is shown a plan view of the pizza box when it is first opened with the top cover panel 26 laid back to expose the second half or top half of the pizza resting on the top floor panel 24. The second half or top half of the pizza can be pulled over to the top cover panel 26 so that when the bottom half of the pizza is uncovered and the box completely opened, the entire pizza is exposed. FIG. 4 shows a plan view after the box has been completely opened with the top floor panel 24 hinged open to expose the first or bottom half of the pizza resting on the bottom floor panel 22. If only one half of the pizza is being consumed the top cover panel 25 can be torn along score line 28 and removed for use as a tray leaving a separate half height containing the first or bottom half of the pizza fully packaged for refrigeration for later usage. FIG. 5 is a cross section taken transversely of the fully closed box of FIGS. 1 through 4. If the boxes are made of kraft board a user may place the pizza on a white thin corrugated sheet called a slip sheet to separate the pizza from the craft board. If the box is made of bleached board such slip sheets would not normally be utilized.

The second embodiment shown in FIGS. 6 through 10 is similar to the first and preferred embodiment except in the second embodiment, when the top of the first compartment is opened, it is more difficult to slide the pizza from the top half into the top of the box for serving the top half of the pizza on the torn off top of the box. This is different from the preferred embodiment where it is easy to slide the top half of the pizza from the top floor panel onto the lid of the box or top cover panel 26 when it is open and which can be torn from the remainder of the box and used as a serving tray for the top half of the pizza. Also, it is easier to separate the first embodiment along the midgirth line by simply tearing along score line 28 than in the second embodiment.

Figure 6:
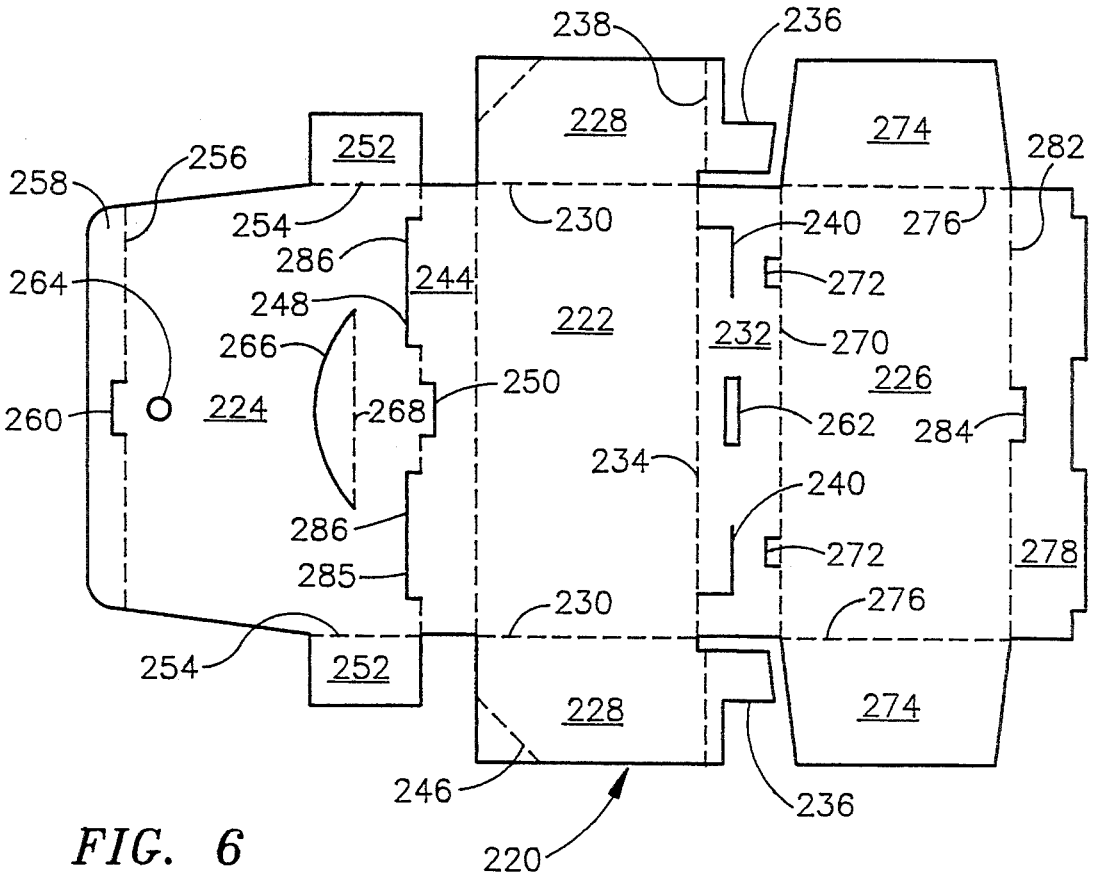
FIG. 6 is a plan view of the box of a second embodiment before being assembled.

With reference to FIG. 6 there is shown a box blank 220 of the second embodiment which is made up of a bottom floor panel 222, top floor panel 224, and a top cover panel 226. The second embodiment is assembled by first folding the end panels 228 about score lines 230 to the vertical position. Next the back panel 232, whose width is equal to the height of the box, is folded upwardly 90 degrees about score line 234. The locking tabs 236 are then folded 90 degrees inward about score lines 238 and are tucked and locked in to locking tab cut lines 240 which are cuts in the back panel 232. Next the first or bottom half of a pizza is place onto bottom floor panel 222.

Connected to the longitudinal and front side of the bottom floor 222 by a score line 242 is front panel 244 which is approximately half the height of the fully assembled box. Connected to the front panel 244 by a discontinuous score line 246 is the top floor panel 224. Discontinuous score line 246 is interrupted by two guides or stops 248 which are cut out of the top floor panel 224, and a vent tab 250 which is cut out of front panel 244. At each end of the top floor panel 224 are short support panels 252 which are connected by score lines 254 to the top floor panel 224. The sides of the top floor panel 224 are slightly tapered convergingly outward from the support panel 252 and are connected by a discontinuous score line 256 to an outer stiffening panel 258. The score line 256 is interrupted by a locking tab 260 which is a cut out extending into the outer stiffening panel 258. To cover the first or bottom half of the pizza, stiffening panels 252 have been hinged inwardly 90 degrees about score lines 254 and outer support panel 258 has been hinged 90 degrees about score line 256, the top floor panel 224 is hinged 90 degrees upward about score line 242 and then hinged 90 degrees to the horizontal about score line 246. When top floor panel 224 is folded over the bottom half pizza, outer stiffening panel 258 serves to stiffen the edge and support panels 252, which are approximately half the height of the fully assembled box, have their outer edges resting on the bottom floor panel 222 and stiffen the edge of and support and space the top floor panel 224 above the pizza. The locking tab 260 is at the same time inserted into locking tab slot 262 in the back panel 232 to both lock the top floor panel into place and provide additional support. Also, located in top floor panel 224 is finger hole 264 which assist in lifting the panel to expose the bottom half pizza. End hand flap 266 hinged about score line 268 can be used for similar purposes.

The second or top half of the pizza is then placed on the top floor panel 224. Top cover panel 226 is connected to the back panel 232 by a discontinuous score line 270 which is interrupted by two vent tabs 272. At each end or side of the top cover panel 226 are tuck and support tabs 274 integrally connected to the top cover panel by score lines 276. At the outer long side of the top cover panel 226 is an upper front panel 278, having two locking tabs 280 extending therefrom. Upper front panel 278 is integrally connected to top cover panel 226 by a discontinuous score line 282, whose continuity is caused by vent tab 284. To cover the second or top half of the pizza resting on top panel 224, the tuck and support tabs are folded inward 90 degrees about score line 276, the upper front panel 278 is folded inward 90 degrees above score line 282, and the panel is pivoted about score line 270 90 degrees. Tuck and support tabs 274 are inserted between the inside of end panel 228 and the outside of support panels 252 with locking tabs 280 being inserted in the locking slots 286 created by stop or guides 248 which serve to assist the locking tabs to enter the slots 286.

Figure 7:
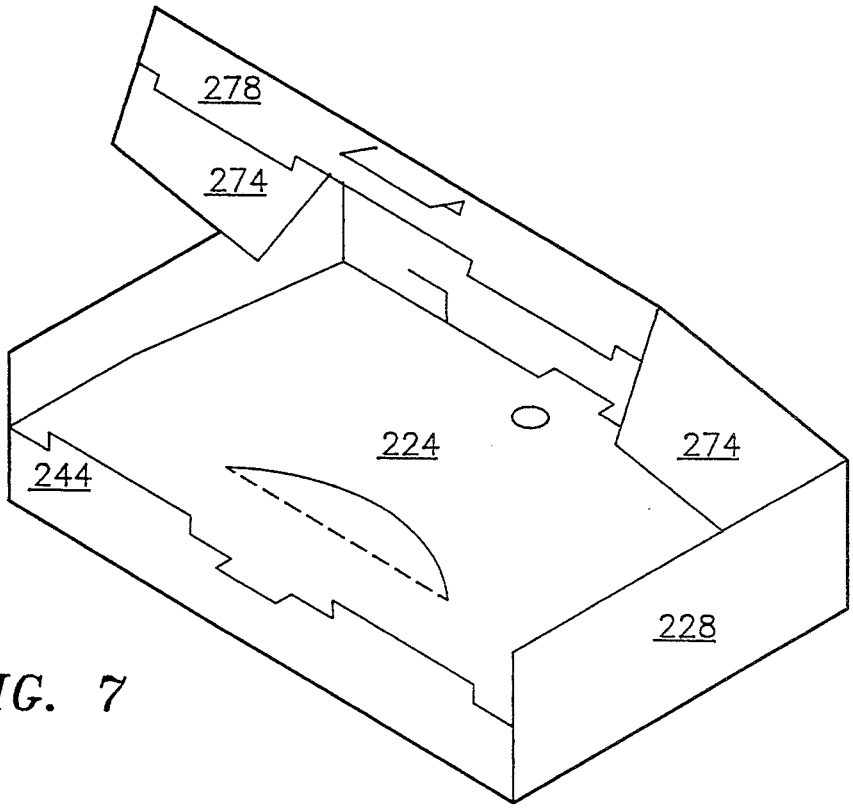
FIG. 7 is a perspective view of the box of the second embodiment shown assembled with the top compartment partially opened.

Shown in FIG. 7 is the box of FIG. 6 partially assembled with the bottom or first half of the pizza in position and prior to the placing of the top or second half of the pizza onto the top floor panel 224.

Figure 8:
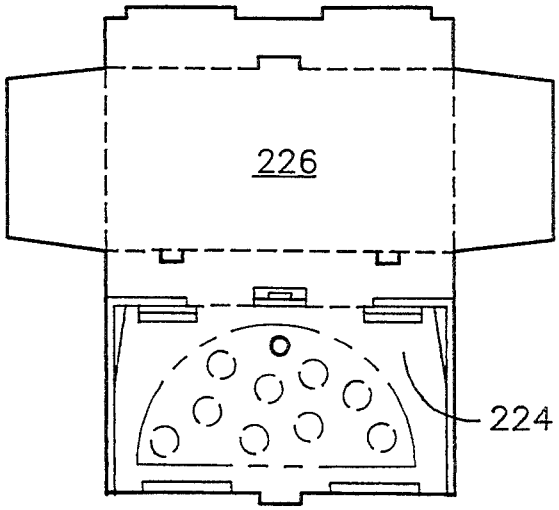
FIG. 8 is a plan view of the box of FIGS. 6 and 7 showing the top half of the pizza in place.

FIG. 8 shows the pizza box of FIGS. 6 and 7 after the top cover panel 226 has been lifted to uncover the top or second half of the pizza which is shown resting on top floor panel 224.

Figure 9:
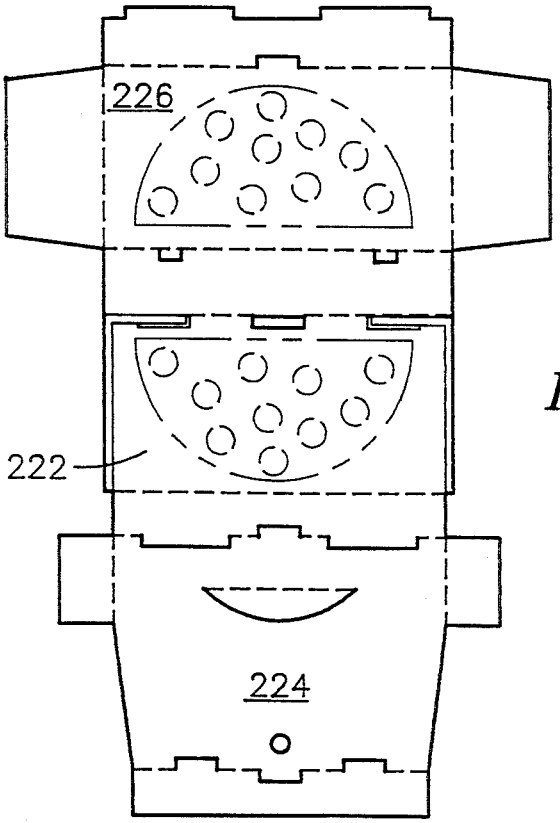
FIG. 9 is a plan view of the box shown in FIG. 8 with the bottom half of the pizza in place before the bottom compartment is enclosed and the top half of the pizza is put in place.

FIG. 9 is a view similar FIG. 8 except the box has been completely uncovered with the top floor panel 224 folded back to reveal the bottom or first half of the pizza resting on the bottom floor panel 222.

Figure 10:
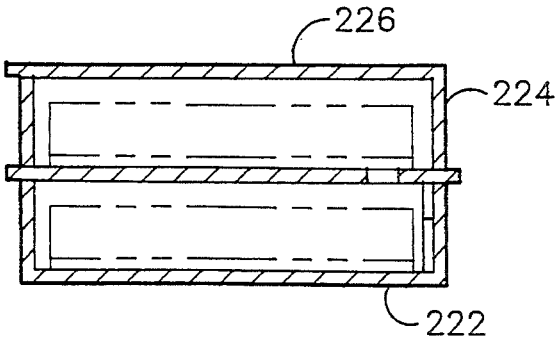
FIG. 10 is a cross sectional view of the second embodiment taken from a short end with the pizza represented by dot-dash lines.

FIG. 10 is a cross section taken transversely of the fully closed box of FIGS. 6 through 9 showing the pizza in place by dot-dash lines.

With reference to FIGS. 11 through 16, there shown a third embodiment of the present invention. The third embodiment is made from two separate components unlike the preferred embodiment and second embodiment which are made from a single piece blank. The major component of the third embodiment is a pizza box 288 which has a back wall 290, two side walls 292 a bottom floor panel 294, and a front wall 296. The side wall 292, each have inside flaps 300 and are connected to the back wall 290, by locking tabs 322, similar to the locking tabs 236 of the second embodiment. The cover 302 has two inside side flaps 304, and a front flap 306 having a locking tab 308 which is adopted to mate with locking tab slot 310 in the front wall.

The front wall also has two locking tabs 298, one at each end. The other component of the third embodiment is a top floor panel 312 in the form of a set in tray having side leg panels 314 extending approximately ½ the height of the box and slightly higher than the thickness of pizza place therein with a short front rigidifying panel 316 and a similar back panel not shown. The floor panel 312 has two vent and space tabs 318 and two finger holes which 320 also serve as vent holes.

Figure 11:
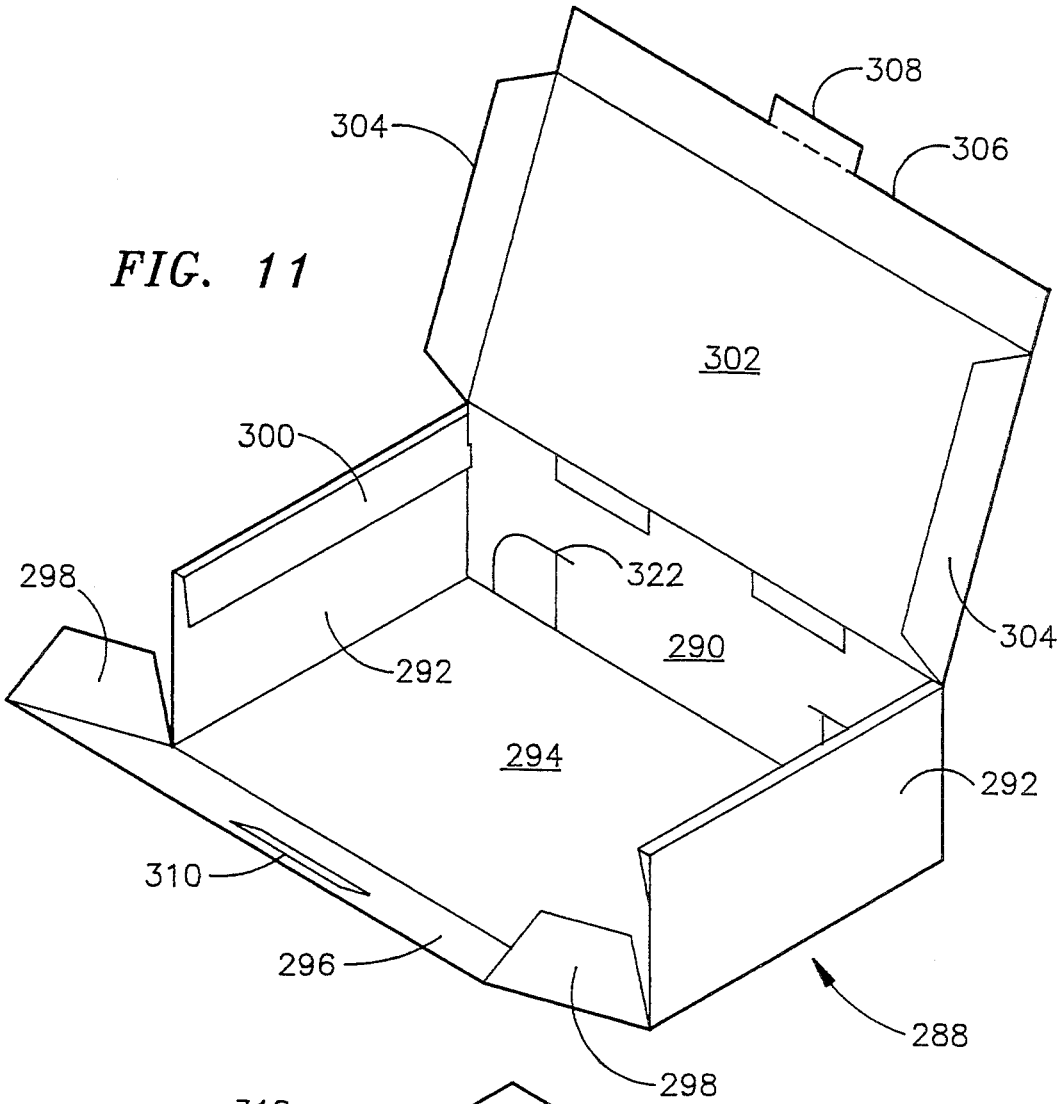
FIG. 11 is a partially assembled box shown in perspective of a third embodiment.
Figure 12:
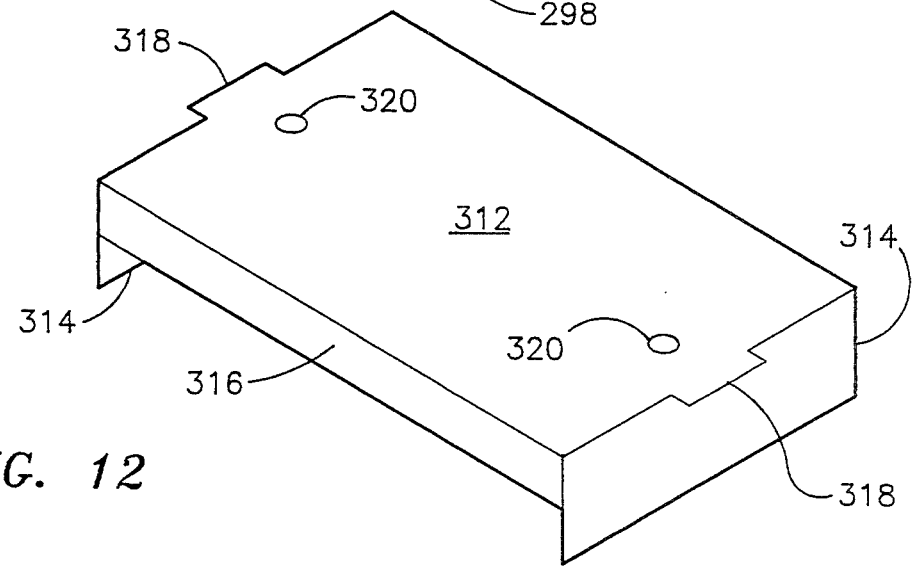
FIG. 12 is a tray to be used in conjunction with the box of FIG. 11.
Figure 13:
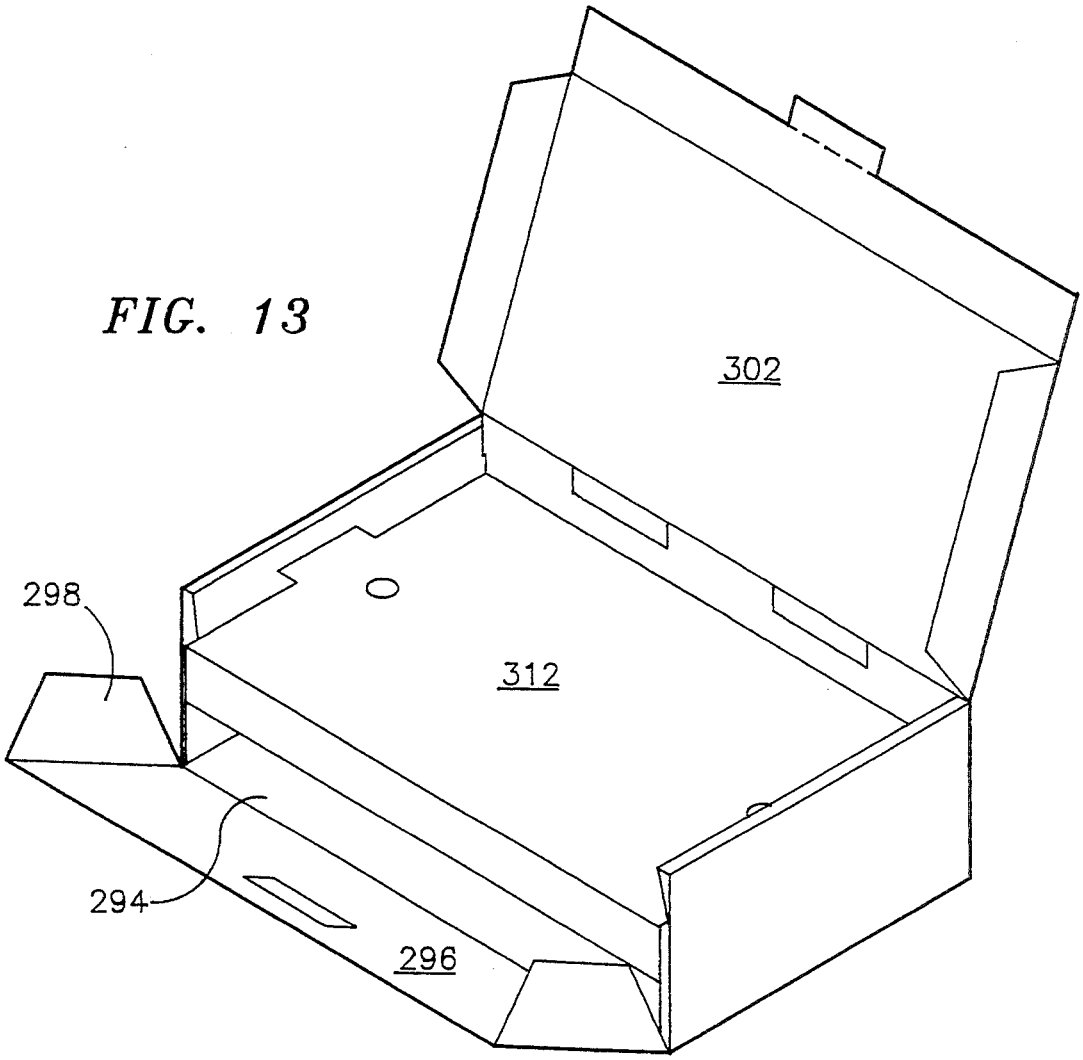
FIG. 13 is a view similar to FIG. 11 with the tray of FIG. 12 in place.

FIG. 13 shows the top floor panel 312 of FIG. 12 set into the pizza box 288 of FIG. 11. The bottom or first half of the pizza is placed on the bottom floor panel 294 of the box of FIG. 11 and then the top floor panel is placed thereover as shown in FIG. 13. Then the top or ! second half of the pizza is placed onto the top floor panel 312 and the front wall 296 closed by placing the locking tabs 298 between the inside of the side wall 292 and the inside flaps 300. Then the cover 302 is closed by inserting the inside side flaps 304 into the inside of the box and the front flap 306 to the front outside of front wall 296 where is held in place by the locking tabs 308 being inserted into locking tabs slot 310.

Figure 16:
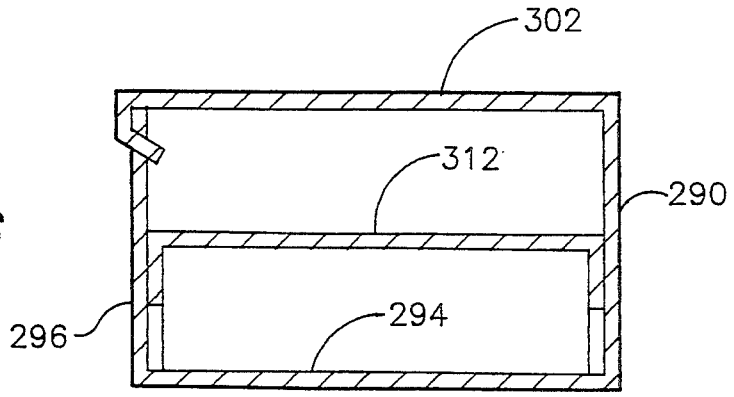
FIG. 16 is a cross sectional view of the assembled and closed box of FIG. 13 taken across the transverse dimension.
Figure 14:
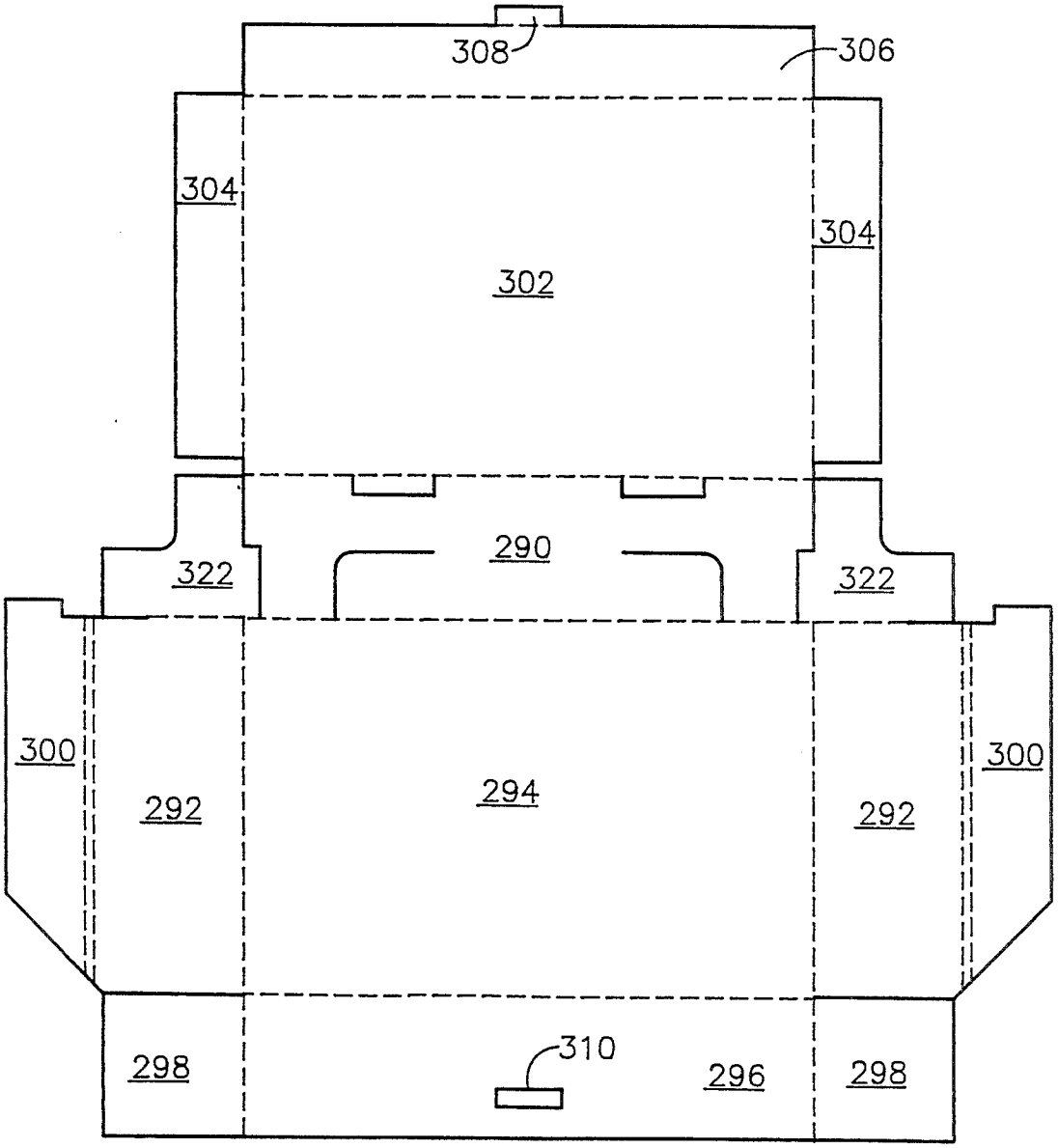
FIG. 14 is a plan view of the box of FIG. 11 before being assembled.
Figure 15:
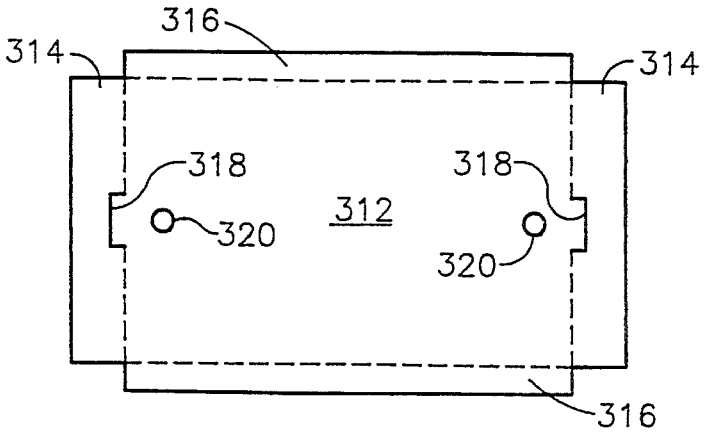
FIG. 15 is a plan view of the tray of FIG. 12 before being assembled.

FIG. 14 is the blank used for making the pizza box of FIG. 11 and FIG. 15 is the blank used for making the top floor panel of 312 of FIG. 12. In both FIGS. 14 and 15 the fold lines are shown in dash lines and the double fold lines are shown in double dash lines. Also, in FIG. 14 the locking tabs 322 are shown at the end of the back wall 290 and these are inserted into the locking tabs cut lines of the back wall 290. FIG. 16 shows a transverse view of the fully assembled closed box of FIG. 13. The embodiment of FIGS. 11 through 16 as shown in FIG. 13 optionally permits the two halves of the pizza to be inserted after the tray has been put into place with the bottom half being put in from the front with the front wall lowered to permit access.

The tray of FIG. 12 can be used as a serving board and may be readily lifted from the box by the finger holes 320 since they are not covered by the semicircular half pizza.

It can readily be appreciated by those who are skilled in the art that the present invention as emplified by the three disclosed embodiments permit two halves of a circular pizza to be packaged in a pizza box, one over the other, in a spaced apart manner, with the pizza box being approximately twice as thick as a normal pizza box for a full circular undivided pizza. The pizza box of the present invention is about twice as long and it is wide with the length being approximately the same as the standard pizza box. The present invention provides a much more readily useable package, utilizes less materials, retains heat better because there is less exterior surface area and provides other advantages including convenience of use.

The method of handling the pizza is by cutting a circular pizza into two semicircular half pieces, partially assembling a special pizza box of the present invention, putting one half of the pizza in a lower compartment of the special pizza box and putting the other half in the upper compartment of the special pizza box which is then closed thereabouts. The two halves are separated with one spaced above the other with the floor of the top compartment serving as the cover for the lower compartment. The special box is then completely assembled by closing the top cover. The pizza is then delivered to the customer who then opens the box to expose first one half of the circular pizza in the top compartment while retaining the other half of the pizza in the lower compartment of the box until needed. Thus, there is provided a unique method of packaging and transferring pizza to a consumer. An additional step would be to remove the cover of the box is by tearing along a perforated line such as along perforated score line 28 of FIG. 2. This permits the bottom half height box or lower compartment with the bottom half of the pizza covered by top floor panel 24 to be held under refrigeration or otherwise for later consumption. The torn away cover can be inverted and used as a tray for serving the top half of the pizza.

The preferred embodiments of the invention has been described in detail. It will be appreciated by those skilled in the art that variations may be made without departing from the scope of the invention or the scope of the appended claims.

What is claimed is:

1. An elongated box for carrying two separated and spaced apart halves of a flat food product stacked one over the other wherein said box is approximately twice as long as it is wide comprising:

a bottom compartment for carrying a first half of said flat food product having a bottom floor panel, a bottom front wall, a bottom rear wall and two bottom side walls, said bottom compartment being approximately twice as long as it is wide and of a height greater than the thickness of said flat food product and approximately one-half the height of said box;

a top compartment for carrying a second half of said flat food product overlying and coextensive with said bottom compartment having a top cover panel, a top rear wall, a top front wall and two top side walls with at least one of said top walls being of approximately one-half the height of said box and said top compartment being of substantially the same size as said bottom compartment;

a single panel separating said top compartment from said bottom compartment that is a integrally hinged to the top of a bottom wall of said bottom compartment with said single panel being approximately twice as long as it is wide and covering said bottom compartment and providing the floor for said top compartment; and an integral hinge forming a tear line joining the top of one of said bottom walls of said bottom compartment to the bottom of said one of said top walls of said top compartment which is approximately one-half the height of said box so that said top cover and said four top walls of said top cover can be separated by tearing from said bottom compartment.

2. The box of claim 1 wherein said single panel which covers said bottom compartment has a flap integrally hinged to said panel along at least one side at a 90 degree angle to said panel to rigidify same.

3. The box of claim 2 wherein said side flaps of said panel are approximately the height of said bottom compartment and serve as legs to support said panel.

4. An elongated box for carrying two separated and spaced apart semicircular halves of a circular pizza stacked one over the other wherein said box is approximately twice as long as it is wide comprising:

a bottom compartment for carrying a first of said semicircular pizza halves having a bottom floor panel, a bottom front wall, a bottom rear wall and two bottom side walls, said bottom compartment being approximately twice as long as it is wide and of a height greater than the thickness of said pizza and approximately one-half the height of said box;

a top compartment for carrying a second of said semicircular pizza halves overlying and coextensive with said bottom compartment having a top cover panel, a top rear wall, a top front wall and two top side walls with at least one of said top walls being of approximately one-half the height of said box and said top compartment being of substantially the same size as said bottom compartment;

a single panel separating said top compartment from said bottom compartment that is a integrally hinged to the top of a bottom wall of said bottom compartment with said single panel being approximately twice as long as it is wide and covering said bottom compartment and providing the floor for said top compartment; and an integral hinge forming a tear line joining the top of one of said bottom walls of said bottom compartment to the bottom of said one of said top walls of said top compartment which is approximately one-half the height of said box so that said top cover and said four top walls of said top cover can be separated by tearing from said bottom compartment.

5. The box of claim 4 wherein said single panel has a flap integrally hinged to said panel along at least one side at a 90 degree angle to said panel to rigidify same.

* * * * *